US012091950B1

(12) United States Patent
Xie et al.

(10) Patent No.: US 12,091,950 B1
(45) Date of Patent: Sep. 17, 2024

(54) MOVING BARREL TYPE OIL PUMPING DEVICE

(71) Applicants: Wei Xie, Surrey (CA); Jing Xie, Calgary (CA)

(72) Inventors: Wei Xie, Surrey (CA); Jing Xie, Calgary (CA)

( * ) Notice: Subject to any disclaimer, the term of this patent is extended or adjusted under 35 U.S.C. 154(b) by 0 days.

(21) Appl. No.: 18/212,194

(22) Filed: Jun. 21, 2023

(51) Int. Cl.
*E21B 43/12* (2006.01)
*E21B 34/08* (2006.01)

(52) U.S. Cl.
CPC ..... *E21B 43/128* (2013.01); *E21B 34/08* (2013.01)

(58) Field of Classification Search
CPC ..... E21B 43/12; E21B 43/128; E21B 34/08
See application file for complete search history.

(56) References Cited

U.S. PATENT DOCUMENTS 3,007,523 A * 11/1961 Vincent ..... E21B 33/12 166/308.1
2014/0262230 A1* 9/2014 Harris ..... E21B 43/124 166/65.1
2017/0022792 A1* 1/2017 Jimenez Vallejo ... E21B 43/126
2020/0318452 A1* 10/2020 Becker ..... F16L 39/005

* cited by examiner

*Primary Examiner* — Dany E Akakpo

(57) ABSTRACT

The present invention relates to the field of oil extraction machinery and provides a moving barrel type oil pumping device. The device includes a winch, a support frame, a pulley, an oil inlet pipe, an oil extraction barrel, and a suction pump. The support frame is installed at the wellhead, and the pulley is suspended from the top of the support frame, directly above the wellhead. The wellhead is equipped with an upper flange, a lower flange, and a casing, with the upper flange and lower flange connected by bolts, and the lower flange threaded into the casing. The winch is equipped with a cable, and the inlet of the suction pump is connected to the oil inlet pipe. The cable passes over the pulley and changes direction, then passes through the upper flange and is suspended from the oil extraction barrel. The end of the oil inlet pipe extends to the bottom of the oil extraction barrel. This oil pumping device does not require oil pipes and pump rods, and it has a simple structure, low production and maintenance costs, achieves significant energy savings, and is reliable and durable.

10 Claims, 3 Drawing Sheets

MOVING BARREL TYPE OIL PUMPING DEVICE

TECHNICAL FIELD

The present invention relates to the technical field of oil production machineries, systems, and technology, and provides a moving barrel type oil pumping device.

BACKGROUND

As oil fields continue to be exploited, the water content in the wells increases, leading to lower oil production rates. Severe sand production in the wells, corrosion and abrasion of oil pipes and pumping rods, sand blockage in the pump, and other issues result in frequent well repair operations. Additionally, high power consumption and production costs make it economically unviable to continue operating some old wells, causing them to be shut down.

To address these problems, a moving barrel type sand control pump is commonly used. This pump employs a fixed plunger and a moving pump barrel structure, which offers advantages such as a simple design, streamlined flow path, reduced risk of rod detachment, minimal sand blockage and burial, corrosion resistance, wear resistance, and long lifespan. It is suitable for wells with severe sand production.

However, existing moving barrel type sand control pumps have their pumps or pump bodies located underground, e.g., below the oil well, making it inconvenient for maintenance and repairs as the wellbore and/or the pump components need to be pulled out for maintenance and repairs. Existing systems have their pumping systems or components located underground, and the oil pumps move together with the oil lifting barrel, resulting in high electricity power consumption.

BRIEF DESCRIPTION OF DRAWINGS

In drawings which show non-limiting embodiments of the invention.

Figure 1:
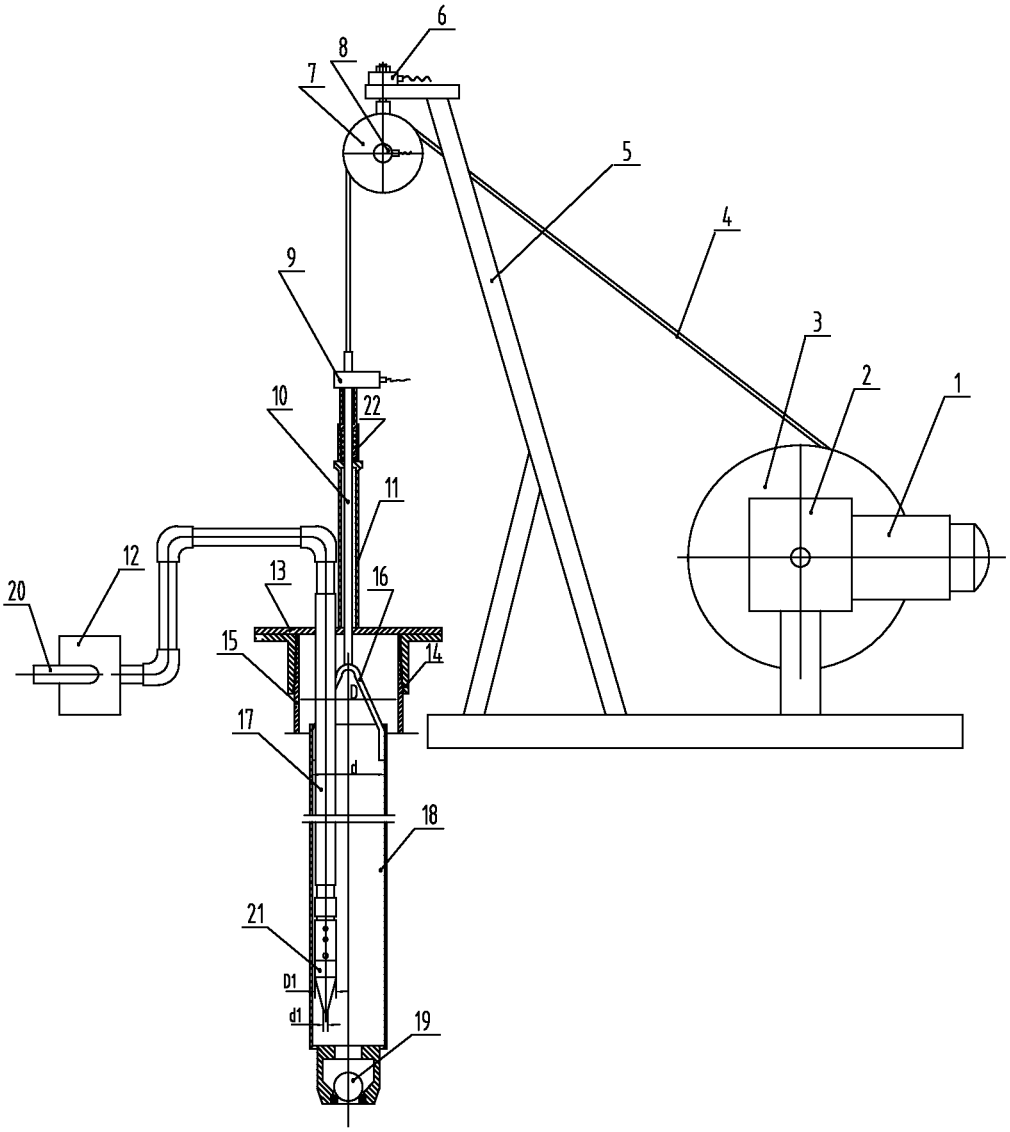
FIG. 1 illustrates an example embodiment of the present invention.
Figure 2:
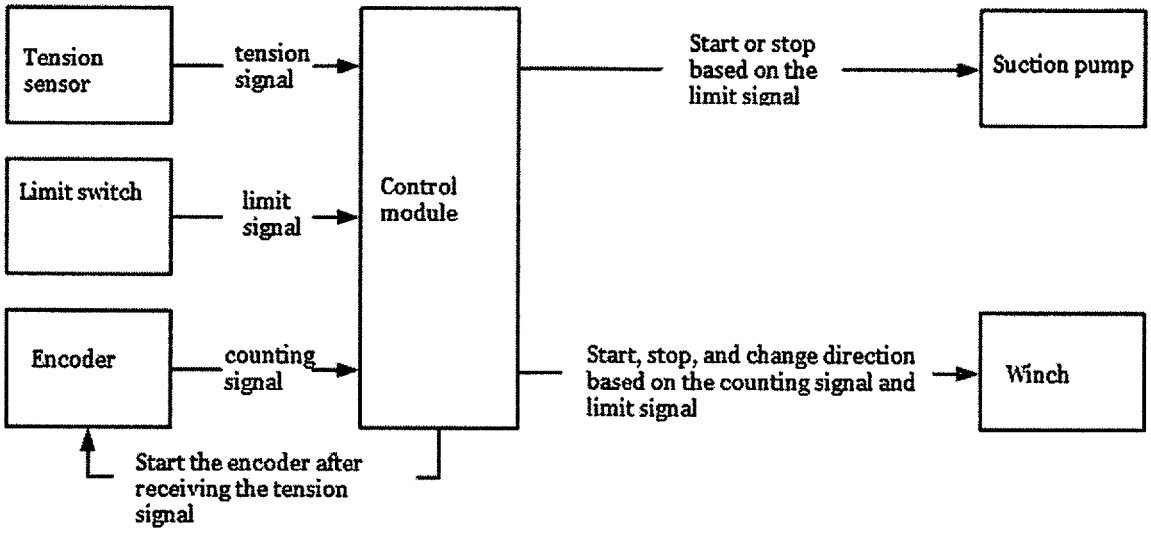
FIG. 2 is a schematic diagram of a control process according to an example embodiment of the present invention.
Figure 3:
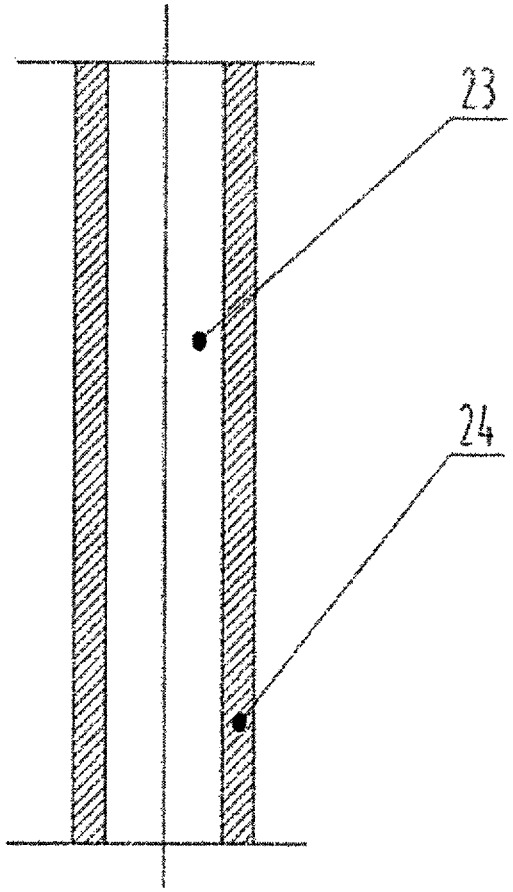
FIG. 3 is schematic diagram of the cable structure according to an example embodiment of the present invention.

In the figures: reference numeral 1 represents the motor, 2 represents the reducer, 3 represents the roller drum, 4 represents the cable, 5 represents the support frame or bracket, 6 represents the tension sensor, 7 represents the pulley, 8 represents the encoder, 9 represents the limit switch, 10 represents the limit cylinder, 11 represents the guide cylinder, 12 represents the suction pump, 13 represents the upper flange, 14 represents the lower flange, 15 represents the casing, 16 represents the lifting ring, 17 represents the inlet pipe, 18 represents the oil lifting barrel, 19 represents the check valve (a one-way valve), 20 represents the oil delivery pipe, 21 represents the guide head, 22 represents the sealing gland, 23 represents the core cable, 24 represents the protective layer.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The objective of this invention is to address the shortcomings of the existing technologies by providing moving barrel type oil pumping devices and systems where the oil pump is located above ground, facilitating maintenance and repairs, and eliminating the need for the oil pump to move up and down with the oil lifting barrel, thus reducing electricity and power consumption.

One aspect of the invention provides a moving barrel type oil pumping device which comprises a winch, a support frame, pulleys, an inlet pipe, an oil lifting barrel, and a suction pump. The support frame is installed above the wellhead, and the pulleys are suspended from the top of the support frame, directly above the wellhead. The wellhead is equipped with an upper flange, a lower flange, and a casing, with the upper flange and lower flange connected by bolts and the lower flange threaded onto the casing. The winch is equipped with a cable, and the inlet pipe is in communication with the suction pump. The cable passes over the pulleys and, after changing direction, goes through the upper flange and is suspended and connected to the oil lifting barrel. The end of the inlet pipe extends to the bottom of the oil lifting barrel.

In some embodiments, the lower end of the oil lifting barrel is equipped with a check valve (i.e., a one-way valve).

In some embodiments, the end of the inlet pipe is equipped with a guide head.

In some embodiments, the main body of the guide head is cylindrical, with the lower end tapered and comprising several inlet holes which allow fluid to pass through.

In some embodiments, a guide cylinder is fixed on the upper flange, and the cable passes through the guide cylinder and the upper flange to connect with the oil lifting barrel.

In some embodiments, the upper end of the guide cylinder is equipped with a sealing gland, and the cable slides in a sliding seal cooperation with the sealing gland.

In some embodiments, the upper end of the oil lifting barrel is equipped with a lifting ring, which is connected to the cable.

In some embodiments, there is a limit switch below the sealing gland.

In some embodiments, there is a limit cylinder positioned between the cable and the guide cylinder, located between the limit switch and the lifting ring (i.e., below the limit switch and above the lifting ring).

In some embodiments, the system includes a tension sensor, an encoder, and a control module. The tension sensor, the limit switch, and the encoder are all communicatively connected to the control module, and the control module is communicatively connected to the suction pump and winch for communication and control.

The advantages of the present invention are as follows: The suction pump is located on the ground and does not move up and down with the oil lifting barrel, making it convenient for maintenance and repair. It reduces the load on the winch, saving energy. There is no need for oil pipes and pumping rods, resulting in a simple structure. It has low production and maintenance costs. It saves electricity. In some embodiments, it saves 70% of electricity. And it is reliable and durable.

Example 1

A moving barrel type oil pumping device, as shown in FIG. 1, is installed at the wellhead and comprises a winch, a support frame or bracket 5, a pulley 7, a guide cylinder 11, a sealing gland 22, an oil lifting barrel 18, a check valve 19, an oil inlet pipe 17, and a suction pump 12.

The wellhead is equipped with a casing 15, and the threaded end of the casing 15 is connected to the lower flange 14. Above the lower flange 14, the upper flange 13 is connected by bolts to the lower flange 14. The upper flange 13 has a guide cylinder 11 located above it, and the upper end of the guide cylinder 11 is equipped with a sealing gland 22.

The winch consists of an electric motor 1, a reducer 2, a roller drum 3, and a cable 4. The power output end of the electric motor 1 is connected to the reducer 2, and the power output end of the reducer 2 is connected to the roller drum 3. The cable 4 is wound around the roller drum 3.

The support frame or bracket 5 is installed just above the wellhead, and a pulley 7 is suspended from the support frame or bracket 5.

The cable 4 passes through the pulley 7 and then sequentially passes through the sealing gland 22, the guide cylinder 11, the upper flange 13, and the lower flange 14 to connect to and suspend the oil lifting barrel 18 inside the wellbore. The cable 4 slides and seals with the sealing gland 22. The upper end of the oil lifting barrel 18 is equipped with a D-shaped lifting ring 16 connected to the cable 4, and the lower end of the oil lifting barrel 18 is equipped with a check valve 19, which allows fluid to flow only from bottom to top in the wellbore.

The inlet of the suction pump 12 is connected to the oil inlet pipe 17, and the outlet of the suction pump 12 is connected to the oil delivery pipe 20.

The other end of the oil inlet pipe 17 passes through the upper flange 13, the lower flange 14, and enters near the bottom position of the oil lifting barrel 18. The bottom position of the oil lifting barrel 18 refers to the bottom position when the oil lifting barrel 18 is at the upper limit position of the casing 15.

Example 2

Example 2 is based on Example 1. Example 2 is additionally equipped with a tension sensor 6, a limit switch 9, a limit cylinder 10, an encoder 8, and a control module.

The tension sensor 6, limit switch 9, and encoder 8 are all connected to the control module.

The tension sensor 6 is installed above the pulley 7 to obtain the cable 4 tension signal.

The encoder 8 is installed on the axle of the pulley 7 to obtain the rotational signal of the pulley 7.

The limit switch 9 is installed below the sealing gland 22 and triggers the limit signal through the limit cylinder 10.

The limit cylinder 10 is fitted on the cable 4 and is positioned between the lifting ring 16 and the limit switch 9.

The control module is connected to the suction pump 12 and the winch for communication and control.

The principle of this example is as follows: The winch is started to lower the oil lifting barrel 18. When the oil lifting barrel 18 descends to the oil level, the tension sensor 6 detects a decrease in cable 4 tension, and the encoder 8 starts counting. At this point, oil enters the oil lifting barrel 18 through the check valve 19. When it reaches the pre-set value, the encoder 8 stops counting. The winch reverses and lifts the oil lifting barrel 18 until it reaches the upper limit position. When the limit cylinder 10 triggers the limit switch 9, a limit signal is sent out, and the winch stops. The suction pump 12 is started, and it removes the oil from the oil lifting barrel 18 through the oil inlet pipe 17, thus completing one pumping cycle. This process repeats to achieve oil pumping.

In this example, the tension sensor 6, limit switch 9, encoder 8, and control module may be conventional electronic components. For example, the tension sensor 6 may also be a gravity sensor or any device capable of detecting changes in cable 4 tension. The limit switch 9 and encoder 8 are commonly used components in winches, and the control module is a commonly used logic function module, such as a microcontroller or a microprocessor. The specific usage methods of these components are well-known to those skilled in the art, and thus, the detailed description is omitted in this disclosure.

Example 3

In another embodiment, an additional guide head 21 is provided at the lower end of the oil inlet pipe 17. The guide head 21 has a cylindrical body with a conical shape at the lower end. The taper of the cone satisfies the condition: (Diameter D1 of the larger end of the cone−Diameter d1 of the smaller end of the cone)/2>(Inner diameter D of the casing 15−Inner diameter d of the oil lifting barrel 18). This condition is necessary to enable the guide head 21 to enter the oil lifting barrel, without being stuck in the space between the casing 15 and the oil lifting barrel.

The core cable 23 of the cable 4 is made of a non-metallic material such as ultra-high molecular weight polyethylene (PE) rope or carbon fiber rope. It has advantages such as high tensile strength, light weight, and corrosion resistance. A protective layer 24, such as nylon, carbon fiber, or glass fiber, is applied to the surface of the core rope 23 to enhance the sealing performance of the sealing gland 22 and prolong the service life of the core cable 23 and the sealing gland 22. In some embodiments, the sealing gland 22 may be made of rubber or some other polymer material.

Although embodiments of the present invention have been illustrated and described, it will be understood by those skilled in the art that various changes, modifications, substitutions, and variations can be made to these embodiments without departing from the principles and spirit of the present invention. The scope of the invention is defined by the appended claims.

What is claimed is:

1. An oil pumping device comprising a winch, a support frame, a pulley, an oil inlet pipe, an oil lifting barrel, and a suction pump, wherein the support frame is installed above a wellhead, and the pulley is suspended from the support frame and located directly above the wellhead, and the wellhead is equipped with an upper flange, a lower flange, and a casing, with the upper flange and lower flange bolted together and the lower flange threaded onto the casing, and the winch is equipped with a cable, and wherein the inlet of the suction pump is connected to the oil inlet pipe, and wherein the cable passes over the pulley and then through the upper flange to be connected with the oil lifting barrel, and an end of the oil inlet pipe extends to a bottom of the oil lifting barrel, and wherein a guide head is provided at the end of the oil inlet pipe, and wherein the guide head comprises a cylindrical body and a tapered cone, and the tapered cone comprises several inlet holes, wherein (D1−d1)/2>(D−d), and wherein D1 is a diameter of a larger end of the cone, d1 is a diameter of a smaller end of the cone, D is an inner diameter of the casing, and d is an inner diameter of the oil lifting barrel.

2. The oil pumping device according to claim 1, wherein a check valve is provided at a lower end of the oil lifting barrel.

3. The oil pumping device according to claim 1, wherein a guide cylinder is fixed on the upper flange, and the cable passes through the guide cylinder and the upper flange to be connected to the oil lifting barrel.

4. The oil pumping device according to claim 3, wherein a sealing gland is provided at an upper end of the guide cylinder, and the cable slides and seals with the sealing gland.

5. The oil pumping device according to claim 4, wherein a lifting ring is provided at an upper end of the oil lifting barrel, and the lifting ring is connected to the cable.

6. The oil pumping device according to claim 5, wherein a limit switch is provided below the sealing gland.

7. The oil pumping device according to claim 6, further comprising a limit cylinder installed between the cable and the guide cylinder, and the limit cylinder is located between the limit switch and the lifting ring.

8. The oil pumping device according to claim 7, further comprising a tension sensor, an encoder, and a control module, wherein the tension sensor, the limit switch, and the encoder are all communicatively connected to the control module, and the control module is communicatively connected to the suction pump and the winch for communication and control.

9. The oil pumping device according to claim 8, wherein in an oil pumping cycle, the winch is started to lower the oil lifting barrel to descend to an oil level, the tension sensor detects a decrease in tension of the cable, and the encoder starts counting, and oil enters the oil lifting barrel through a check valve at a lower end of the oil lifting barrel, and when a pre-set amount of oil has entered the oil lifting barrel, the encoder stops counting, and the winch reverses and lifts the oil lifting barrel to an upper limit position, and then the winch stops and the suction pump is started to remove the oil from the oil lifting barrel through the oil inlet pipe.

10. The oil pumping device according to claim 1, wherein the suction pump is located above ground.

* * * * *